United States Patent [19]

Schaller

[11] Patent Number: 4,535,668

[45] Date of Patent: Aug. 20, 1985

[54] MAGNETIC PICKUP FOR STRINGED INSTRUMENTS

[76] Inventor: Helmut F. K. Schaller, Kuckucksweg 16, Feucht 1, Fed. Rep. of Germany

[21] Appl. No.: 573,813

[22] Filed: Jan. 25, 1984

[30] Foreign Application Priority Data

[DE] Fed. Rep. of Germany .....

[51] Int. Cl.[3] ..... G10H 3/18

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 2,334,744 | 11/1943 | Benioff | 84/1.16 |
| 2,573,254 | 10/1951 | Fender | 84/1.15 |
| 2,964,985 | 12/1960 | Webster | 84/1.15 |

*Primary Examiner*—Stanley J. Witkowski

*Attorney, Agent, or Firm*—McCormick, Paulding & Huber

[57] ABSTRACT

A magnetic pickup for use with a guitar or other instrument having ferro-magnetic strings has a pole piece for each string which is easily adjustable by hand to vary the strength and phase of the output signal produced by the vibration of the associated string.

6 Claims, 7 Drawing Figures

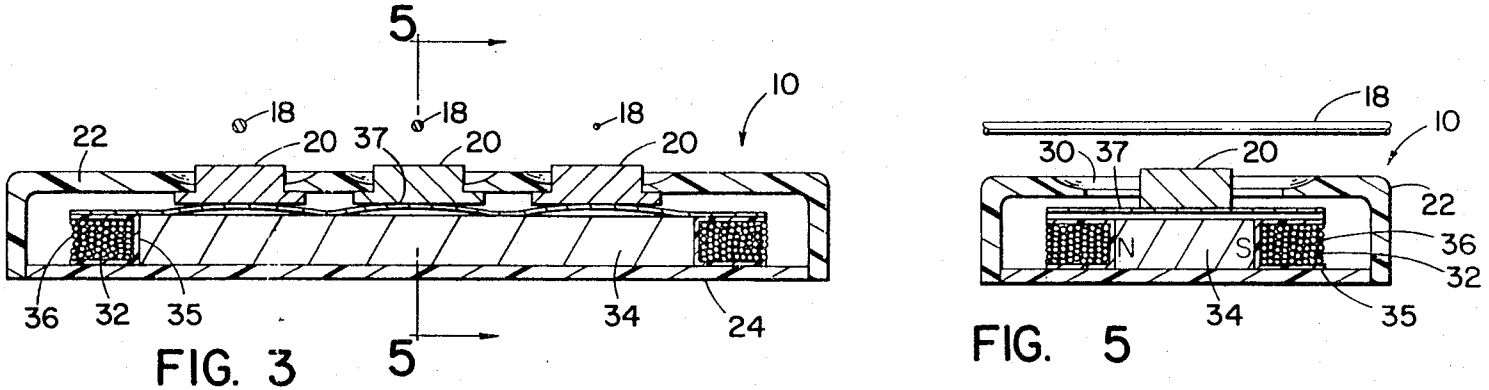
FIG. 3
FIG. 5
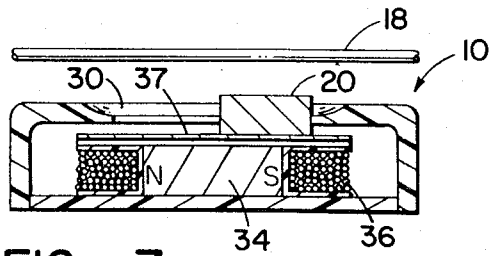
FIG. 7
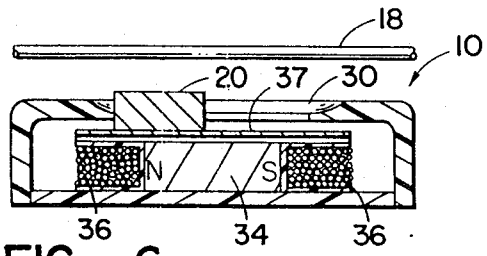
FIG. 6

MAGNETIC PICKUP FOR STRINGED INSTRUMENTS

BACKGROUND OF THE INVENTION

This invention relates to pickups for stringed musical instruments, such as guitars, for creating electrical signals subsequently amplified and applied to a speaker or the like to produce an amplified version of the sound produced by the instrument strings, and deals more particularly with such a pickup of the magnetic type wherein the signals are induced in a coil so associated with a permanent magnet that the vibrations of the strings produce changes in the magnetic flux linking the coil.

Magnetic pickups for use with instruments having strings made of steel or other ferro-magnetic material are well known in the art. Such pickups are conventionally located below the strings of the instrument, and because of their thickness some recess or hole usually needs to be made in the top surface of the instrument to accommodate the pickup.

Magnetic pickups are also known which have a plurality of pole pieces, one underlying each string, each of which pole pieces is adjustable toward and away from its string to vary the fundamental strength of the signal induced in the coil by the vibration of the string associated with that pole.

The general object of the present invention is to provide an improved form of magnetic pickup for use with stringed instruments which pickup has a relatively low profile or thickness so that, if desired, it may be mounted on the top surface of an instrument without the need for making holes or recesses in such top surface.

A further object of the invention is to provide a magnetic pickup of the foregoing character wherein the signal induced in the associated coil by the vibration of a string may be varied not only as to strength but also as to phase to allow the production of a range of effects broader than can be obtained with a pickup wherein the signal output is variable as to strength only.

In keeping with the above object, a further more specific object of the invention is to provide a pickup whereby the strength and phase of the output signal produced by the vibration of each string of the instrument with which it is used may be individually adjusted, and a still further specific object is to provide such a pickup wherein the adjustment for each string is readily carried out by hand in a simple manner without the need for special tools.

Other objects and advantages of the invention will be apparent from the following detailed description of a preferred embodiment.

SUMMARY OF THE INVENTION

The invention resides in a magnetic pickup for use with a guitar or other similar stringed musical instrument with the pickup comprising at least one magnet adapted to underlie at least one string of the instrument and having opposite poles displaced from one another along the length of the string. A coil surrounds the magnet, and a pole piece is located between the magnet and the associated string with the pole piece being movable relative to the magnet in the direction parallel to the length of the string. Therefore, the pole piece may be moved from one position at which it favors one pole of the magnet and an associated side of the coil, thereby causing more of the magnetic flux to pass through one side of the coil than the other and to induce a relatively strong signal of one phase in the coil, to another position at which the pole piece favors the other pole of the magnet causing a relatively strong signal of opposite phase to be induced in the coil. At an intermediate position the pole piece is equally positioned relative to the two poles of the magnet and thereby causes only a very low signal, if any, to be induced in the coil. The pole piece may be set at any position along its path of travel so that any strength of output signal of either phase between the maximum and minimum available may be selected.

BRIEF DESCRIPTION OF THE DRAWINGS

FIG. 3 is an enlarged cross-sectional view taken generally on the line 3—3 of FIG. 2.

FIG. 5 is a cross-sectional view taken on the line 5—5 of FIG. 3 and showing the illustrated pole piece in a middle or neutral position.

FIG. 6 is a cross-sectional view similar to FIG. 5 but showing the pole piece at the position creating a maximum output signal of one phase.

FIG. 7 is a cross-sectional view similar to FIG. 5 but showing the pole piece at the position creating a maximum output signal of a phase opposite to that of FIG. 6.

DETAILED DESCRIPTION OF THE PREFERRED EMBODIMENTS

A magnetic pickup embodying the broader features of this invention has a pole piece for each of the strings of the instrument with which it is used. Therefore, in the case of a six string guitar the pickup has six pole pieces. Each pole piece in turn works with its associated string to form part of a flux path through it, through the string and through a magnet and coil. The number and arrangement of coils and magnets may vary so that, for example, there may be, in the case of a six string guitar, a single magnet and a single coil for all six pole pieces, or there may be a single magnet and a single coil for each pole piece, or one magnet and coil pair may serve a number of pole pieces. In the pickup shown by the accompanying drawings, there are two magnet-coil pairs each serving three pole pieces, but this form of pickup has been chosen for illustration purposes only and the invention is not limited to it. Also, although the illustrated and preferred construction of the pickup lends itself to making the pickup with a relatively small thickness, the pickup could be made with a greater thickness and mounted in a recesses or hole in the instrument if desired. Also, the pickup need not necessarily be mounted on the soundboard or top surface of an instrument but may, if desired, also be located in the central soundhole of the guitar if the guitar is of the type including such soundhole.

Figure 1:
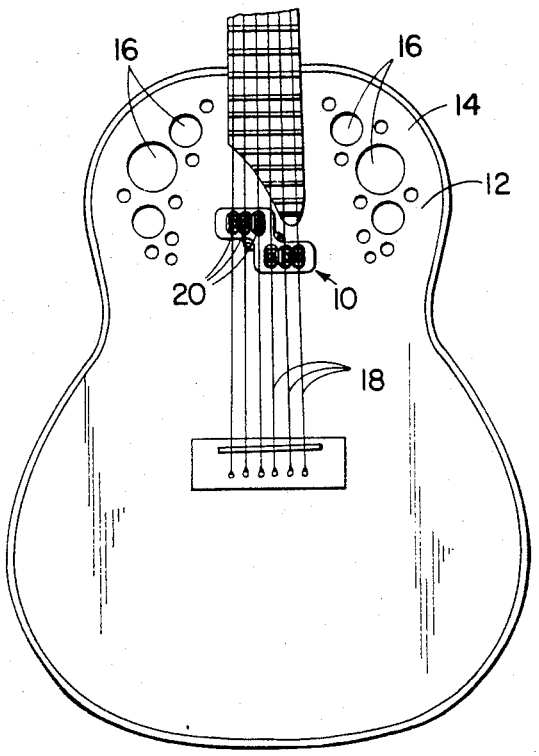
FIG. 1 is fragmentary plan view of a guitar equipped with a magnetic pickup embodying the invention.
Figure 2:
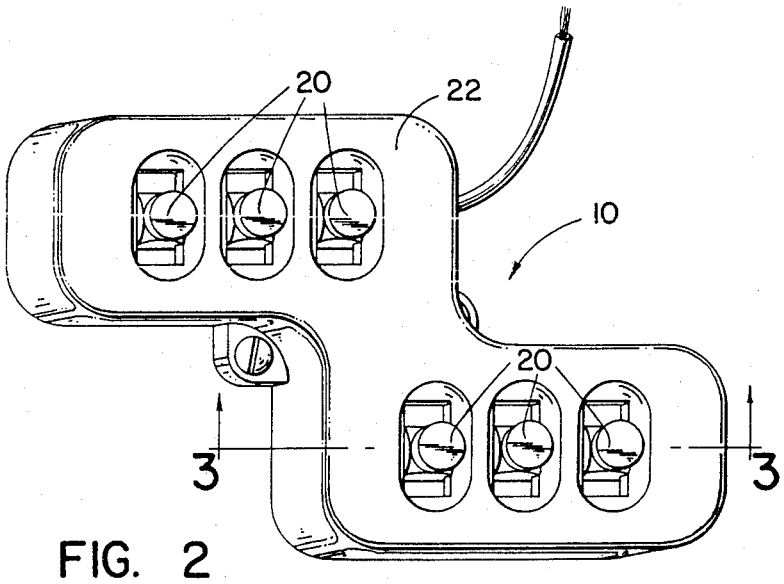
FIG. 2 is a perspective view of the pickup of FIG. 1.
Figure 4:
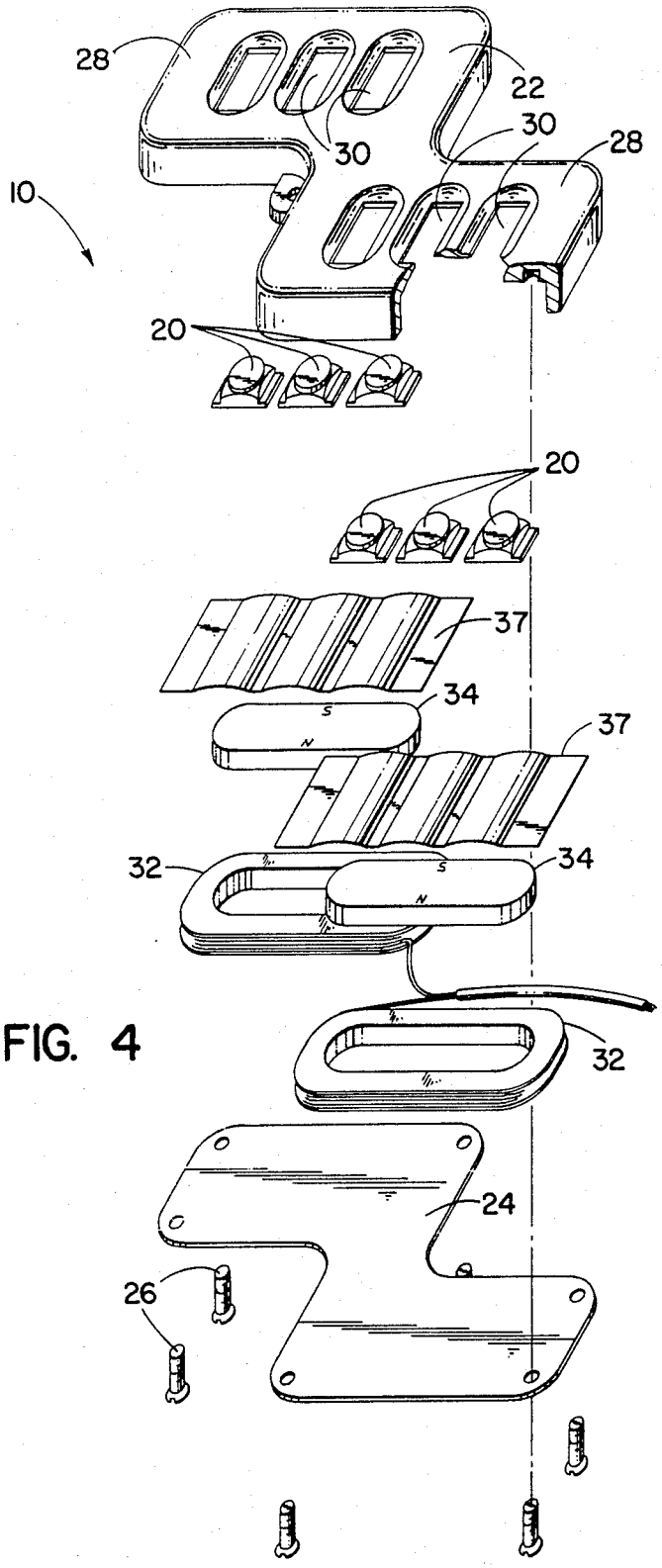
FIG. 4 is an exploded perspective view of the pickup of FIG. 2.

Turning, therefore, to FIG. 1, a pickup embodying the invention is indicated generally at 10 and is shown to be mounted to the top surface 12 of a guitar 14 of the type having sound openings 16, 16 in its upper bouts instead of a central soundhole. The guitar has six strings 18, 18 and the pickup 10 likewise has six pole pieces 20, 20 each underlying a respective one of the strings.

The construction of the pickup 10 is shown in more detail in FIGS. 2 to 5. Referring to these figures, the pickup has an inverted cup-shaped case 22, made of plastic or other nonmagnetic material, closed by a plastic bottom plate 24, also made of plastic or other nonmagnetic material, held to the case 22 by a number of screws 26, 26 threadably engaged with the case. The case 22 is designed so as to have two connected sections 28, 28 each having three elongated rectangular openings 30, 30 in its upper wall.

Each section 28, 28 of the case receives one coil assembly 32, a magnet 34 which fits into the coil assembly, a leaf spring 37 made of brass or other nonmagnetic material and three of the pole pieces 20, 20.

As best seen in FIG. 5 each coil assembly 32 consists of a nonmagnetic plastic bobbin 35 and a coil 36. The coil assemblies 32, 32 and the magnets 34, 34 are of equal thicknesses so that when a magnet is received in its coil assembly, as shown in FIG. 5, the top surface of the magnet is flush with the top surface of the bobbin, and preferably the magnet is glued to, press fitted with or otherwise fixed to its associated coil bobbin so as to form a unitary component.

On top of each of the two magnets and its associated coil assembly 32 is the associated leaf spring 37 on top of which rests the related three pole pieces 20, 20, of magnetic material, each of which projects upwardly through a corresponding one of the openings 30, 30 in the case 28. Each pole piece is guided by engagement with the case for sliding movement along the length of its case opening 30, and the portions of each pole piece which underlie the margins of its opening 30 are pressed upwardly against the case by the leaf spring 37 so that the pole piece can be slid by manual force along the length of its path of movement and will frictionally hold the position to which it is moved.

Referring now to FIGS. 5, 6 and 7, these figures show the way in which any one of the pole pieces 20, 20 may be moved along the length of its case opening 30 to adjust the strength and phase of the electrical signal induced in the associated coil 36 by vibration of the associated string 18. Referring to these figures, FIG. 5 shows the pole piece 20 positioned midway between the two ends of its path of movement. In this position it is centered relative to the poles of the magnet 34 so as to equally favor both the north and south poles of the magnet, and in this position it will shunt from the string 18 a large amount of the flux which would otherwise pass through the string. Also, the amount of flux linking the portion of the coil adjacent the left or north pole of the magnet will be approximately equal to that linking the portion of the coil adjacent the right or south pole of the magnet, and the phases of the voltages induced in these two portions of the coil will be opposite to one another so that such two voltages will at least approximately cancel one another. Therefore, with the pole piece 20 in the FIG. 5 position the total output signal induced in the coil 36 by the vibrating string 18 will have its lowest value, and such value may be substantially zero.

In FIG. 6 the pole piece 20 is shifted to the illustrated left-hand end of its path of movement at which it overlies and therefore favors the north pole of the magnet and also overlies the left portion of the coil 36 located adjacent the north pole of the magnet. Therefore, the total signal induced in the coil 36 will have a maximum value and will be of one phase due to the magnetic flux linking more of one side of the coil 36 than the other.

FIG. 7 shows the pole piece 20 moved to the opposite end of its path of movement in comparison to FIG. 6. In this positon the pole piece overlies and favors the south pole of the magnet 34 and also overlies the right-hand side of the coil 36 adjacent the south pole. Therefore, in this position of the pole piece 20 a strong total signal will again be induced in the coil 36 but its phase will be opposite to that of the phase of the sgnal induced in the coil when the pole piece is in the FIG. 6 position.

Of course, the pole piece 20 may be set to any intermediate position between those shown in FIGS. 5, 6 and 7. In general, as the pole piece is moved from its FIG. 6 to its FIG. 5 position the signal induced in the coil 36 will remain of the same phase but will decrease in strength. As the pole piece is then moved from the FIG. 5 position to the FIG. 7 position the signal will change in phase and will gradually increase in strength.

I claim:

1. A magnetic pickup for use with guitars or other musical instruments having ferro-magnetic strings, said pickup comprising a magnet adapted to underlie at least one string of an instrument and having opposite poles displaced from one another along the length of such a string when said pickup is attached to an instrument, a coil surrounding said magnet, and a pole piece located between said magnet and said string when said pickup is attached to said instrument, said pole piece being movable relative to said magnet in the direction parallel to said string.

2. A magnetic pickup as defined in claim 1 further characterized by said magnet having a top face, said coil being part of a coil assembly, and said coil assembly having a top face flush with said top face of said magnet, said pole piece being movable along a path extending over both said top face of said magnet and said top face of said coil assembly.

3. A magnetic pickup as defined in claim 2 further characterized by said coil assembly comprising a nonmagnetic bobbin and a coil received on said bobbin, said bobbin having a central opening in which said magnet is fixedly received.

4. A magnetic pickup as defined in claim 1 further characterized by a first portion of said coil being located adjacent one of said poles of said magnet and a second portion of said coil being located adjacent the other of said poles of said magnet, said pole piece being movable between a first position at which it overlies said one pole of said magnet and at least part of said one portion of said coil and is spaced from overlying relationship with said second portion of said coil and a second position at which it overlies said other pole of said magnet and at least a portion of said second portion of said coil and is spaced from overlying relationship with said first portion of said coil.

5. A magnetic pickup as defined in claim 1 further characterized by said magnet being of such length perpendicular to its direction of magnetization as to extend across a plurality of strings, and there being a plurality of pole pieces each associated with a respective one of said strings, each located between its string and said magnet, and each movable relative to said magnet in the direction parallel to its string.

6. A magnetic pickup as defined in claim 1 further characterized by there being a plurality of magnets each associated with at least one string of said instrument when said pickup is attached to said instrument, each of said magnets being surrounded by a coil, and a plurality of pole pieces each located between one of said magnets and one of the strings associated with such magnet, each of said pole pieces being movable relative to its associated magnet in the direction parallel to its associated string.

* * * * *